US006361398B1

(12) United States Patent
Knapp

(10) Patent No.: US 6,361,398 B1
(45) Date of Patent: Mar. 26, 2002

(54) NURSING GARMENT

(76) Inventor: Christine Knapp, P.O. Box 2666, Edgewood, NM (US) 87015

( * ) Notice: Subject to any disclaimer, the term of this patent is extended or adjusted under 35 U.S.C. 154(b) by 0 days.

(21) Appl. No.: 09/781,183

(22) Filed: Feb. 13, 2001

(51) Int. Cl.[7] ..... A41C 3/01
(52) U.S. Cl. ..... 450/37; 450/36
(58) Field of Search ..... 450/36, 37, 38, 450/34, 32, 86, 88, 57; 2/73

(56) References Cited

U.S. PATENT DOCUMENTS

| | | | | |
|---|---|---|---|---|
| 2,485,313 A | * | 10/1949 | Rabinowitz | 450/36 |
| 2,925,816 A | * | 2/1960 | Rosenthal | 450/38 |
| 3,203,424 A | * | 8/1965 | Garutso | 450/36 |
| 3,409,017 A | * | 11/1968 | Ramsell | 450/36 |
| 3,425,420 A | * | 2/1969 | Steinberger | 450/36 |
| 4,335,728 A | * | 6/1982 | Fildan | 450/36 |
| 4,390,024 A | * | 6/1983 | Williams | 450/36 |
| 4,550,734 A | * | 11/1985 | Porco | 450/36 |
| 5,269,720 A | * | 12/1993 | Moretz et al. | 450/37 |
| 5,558,556 A | * | 9/1996 | Froehlich | 450/86 |

* cited by examiner

*Primary Examiner*—Gloria M. Hale
(74) *Attorney, Agent, or Firm*—Kenneth E. Darnell

(57) ABSTRACT

A bra or garment configured to function at least in part in the manner of a brassiere and usable by a nursing mother for improved ease of nursing an infant child, the invention provides dual exterior bra cup covers releasably fastened about certain peripheral portions thereof to portions of a body-encircling band or foundation garment, which cup covers are permanently fastened along other peripheral portions to the bra or foundation garments, the covers further being disposed on front surfaces of the bra or garment in surmounting relation to the breast of a user when the bra or garment is worn. The cup covers of the garment can each be opened from respective locations substantially under or near the underarms of a user to expose interior cups having a central opening formed in each of said interior cups, thereby to facilitate nursing by an infant such as when the infant is held in the crook of the arm of a user. The exterior cup covers can be opened partially or pulled fully toward the center of the garment for full opening, the necessary degree of opening of the cup covers being controllable as desired to accomplish the nursing function.

14 Claims, 4 Drawing Sheets

NURSING GARMENT

BACKGROUND OF THE INVENTION

1. Field of the Invention

The invention relates to garments intended to support the breast of a user and particularly of a nursing mother to allow nursing of an infant, exterior cup covers opening from the sides of the garment and being drawn toward the center of the garment enabling access to the interior of the bra to allow nursing of an infant.

2. Description of the Prior Art

Nursing garments have long been known in the art and have taken a number of forms including the form of a brassiere or other garment having a portion thereof which functions essentially as a brassiere, such garments including foundation garments such as slips or the like and exterior garments including blouses, swimwear, etc. A nursing bra or garment differs from a brassiere in that provision is made in the structure of a nursing garment to displace structure covering one or both breasts of a user of the garment to allow nursing by an infant.

In U.S. Pat. No. 4,911,677, White discloses a nursing bra which is pulled open from the center of the garment toward the underarm area. Since that portion of the bra of White which normally covers each breast of a user is disconnected substantially centrally of the bra and pulled in a sidewise direction to uncover the breast for nursing, the infant would typically be held centrally of the body of the user of the bra with the infant's head turned toward the breast which is to be used to nurse the infant. That portion of the bra normally covering the breast would then lie back toward the underarm area of the user. Cradling the infant in a more natural manner in the crook of the arm is thus rendered difficult with the White bra since the portion of the bra pulled toward the underarm area would effectively lie between the infant and the breast which is to be used for nursing. White, however, is an example of one of the few nursing bras or garments which does not open in a downward direction such as from the middle of the cup of a bra or the top of such a cup. A substantial percentage of nursing bras open from the top of each cup, the cup disconnecting from the body of the bra at a location near the top of the bra and then being pulled downwardly to expose the breast which is to be used for nursing. Even though most nursing bras open in this manner, it is to be seen that an infant held centrally of the mother's body or in the crook of her arm will be positioned such that those portions of the cup which are pulled downwardly to expose the user's breast will lie in a position which interferes with desirable communication between the infant and the breast of the nursing mother. Other nursing bras and garments are shown by Turner et al in U.S. Pat. No. 6,074,273; Eggen, in U.S. Pat. No. 5,611,086 and Witczak, in U.S. Pat. No. 5,461,725. In the nursing bras and garments shown in these three patents, portions of the bra essentially acting as cups and covering the breast of a user are detached from locations centrally of the cups with major portions of the cup material being pulled downwardly for nursing.

Although not a nursing bra or garment, Garutso, in U.S. Pat. No. 3,203,424, discloses a brassiere having cup portions which are releasably fastened to body portions of the garments along lower and side portions of said cups. The cups of Garutso are intended to be adjusted by virtue of this releasable fastening to accommodate breasts of differing sizes such that the cup portions of Garutso will fit a number of users having differing breast dimensions. Garutso does not provide a nursing bra or nursing garment which intends to function in a manner which will allow a folding away of cup portions of the bra or garment to facilitate nursing by an infant in the most natural manner, that is, when the infant is held within the crook of an arm of the nursing mother. The art has thus not been provided with a nursing bra or garment having fastening elements at locations of each bra cup on lateral sides of the cup such that the bra or garment can be opened for nursing in a direction from the underarm area toward the center of the bra cup with material forming the bra cup then being folded toward the center of the garment and away from obstructing relation between the infant's head and the breast of the nursing mother. The present invention provides this advantage as well as other advantages when the total structure of a bra or garment configured according to the best mode of the invention is disclosed hereinafter.

SUMMARY OF THE INVENTION

The invention provides a nursing bra or other form of nursing garment wherein at least a portion of the garment functions substantially in the manner of a bra and further facilitates nursing of an infant in a particularly natural position when the infant is held in the arms of a nursing mother. Such a garment typically includes a body-encircling foundation having strap-like elements which connect to each other in a conventional manner behind the user's back. The invention can also be provided in bras which hook in the front. Shoulder straps may also be provided to stabilize the garment on the body of a user. The foundation of the nursing bra or garment is typically open at locations where the garment covers the breast of a user, these locations being covered by cup covers which are attached to the foundation about the openings and which can be opened with the material of the cup being moved away from the opening to allow access to the breast of a user for nursing.

At least a portion of each of the cups about the periphery thereof can be permanently attached such as by sewing to portions of the foundation centrally thereof and in the front of the foundation to cause inwardly disposed peripheral portions of the cups to be fixed in place according to the teachings of the present invention. Fastening elements, such as loop and pile fasteners which include fastening elements known commonly as VELCRO, attach lowermost peripheral portions of each of the cups and usually some side portion thereof which may be continuous with fastening elements along the lower portion of the cups to allow ready disconnection of the cup at a certain point, typically where the fastening elements terminate, to allow the cup to be opened for nursing in a direction from the underarm area toward the center of the bra cup. Certain peripheral portions of each of the bra cups, typically about 25% of the total peripheral dimension, and extending from termination of the fastening elements to the beginning of the fixed periphery, facilitates disconnection of the cup from the foundation of the garment with the cup being moved away toward the center of the garment. It is to be understood that the fastening elements could extend about substantially the full periphery of the cup or that portion of the periphery of the cup which is not fixed to the garment foundation as aforesaid.

Unfastening of the cup from the garment foundation to expose the breast of a user is seen to expose interior cups having central apertures formed therein, the interior cups providing a covering function even when the exterior cup is opened and pulled away while still retaining the ability to access the breast of a user for nursing.

As an option, a covering band of soft material disposed adjacent to the peripheral portions of each cup lie substantially over peripheral edges of the cup when the cup is in place covering the breast of a user. When the cup is pulled away to expose the breast of a user, the band of material is displaced outwardly but can be pressed back inwardly over the portion of the loop and pile fastener which remains on the foundation of the garment about portions of the opening normally covered by the external cup. The band of soft material prevents contact between the face of the nursing infant and that portion of the fastening elements which remain on the foundation of the garment, thereby improving the comfort of the infant.

A further option encompassed by the invention includes provision of a pocket in the cups of the bra, these pockets receiving pads which inter alia increase comfort. Straps of the bra can be configured with an appropriate conventional clasp to easily receive slip-on padding which reduces discomfort associated with straps "biting" into portions of the user's shoulders.

It is accordingly a primary object of the invention to provide a nursing bra or nursing garment having exterior cup elements normally covering the breast of a user and being releasably fastened to the garments about at least portions of openings in the garment through which the breast of a user extend, fastening elements at locations of the exterior cups on lateral sides of the cups being disconnected so that the bra can be opened for nursing in a direction from the underarm area of a user toward the center of the respective cup.

It is another object of the invention to provide a nursing bra or garment having interior cups exposed on opening of the exterior cup, the interior cup having a central opening formed therein to facilitate nursing.

It is a further object of the invention to provide a nursing bra or garment having fastening elements provided about at least a portion of the periphery of exterior cups to hold said cups in place on a foundation of the garment, a band of relatively soft material being provided adjacent the periphery of the cup at those portions thereof where fastening elements are provided so that the band of relatively soft material can be pressed over exposed portions of the fastening elements joined to the foundation of the garment when the exterior cup is moved away from a position normally covering the breast of a user.

A still further object of the invention is to provide a pocket in each bra cup for receipt of a shaped pad therein to increase a user's comfort.

Yet another object of the invention is to provide padding capable of being slipped onto straps of the present bras to increase a user's comfort and/or to absorb lacteal discharge.

Further objects and advantages of the invention will become more readily apparent in light of the following detailed description of the preferred embodiments.

DESCRIPTION OF THE PREFERRED EMBODIMENT

Figure 1:
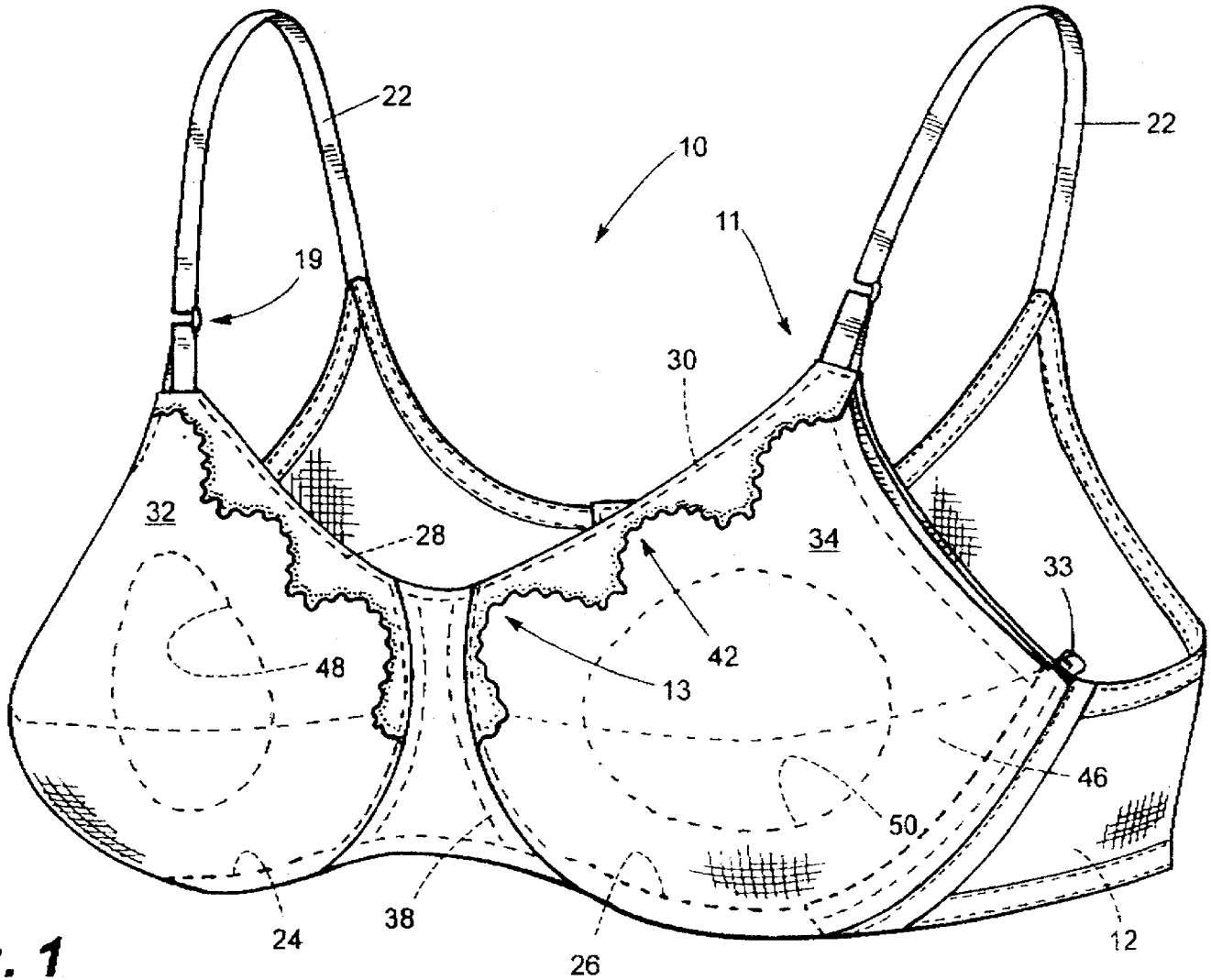
FIG. 1 is a perspective of a nursing bra configured according to the invention with exterior cups shown held in place on the garment in a usual configuration such as when nursing is not being effected.
Figure 2:
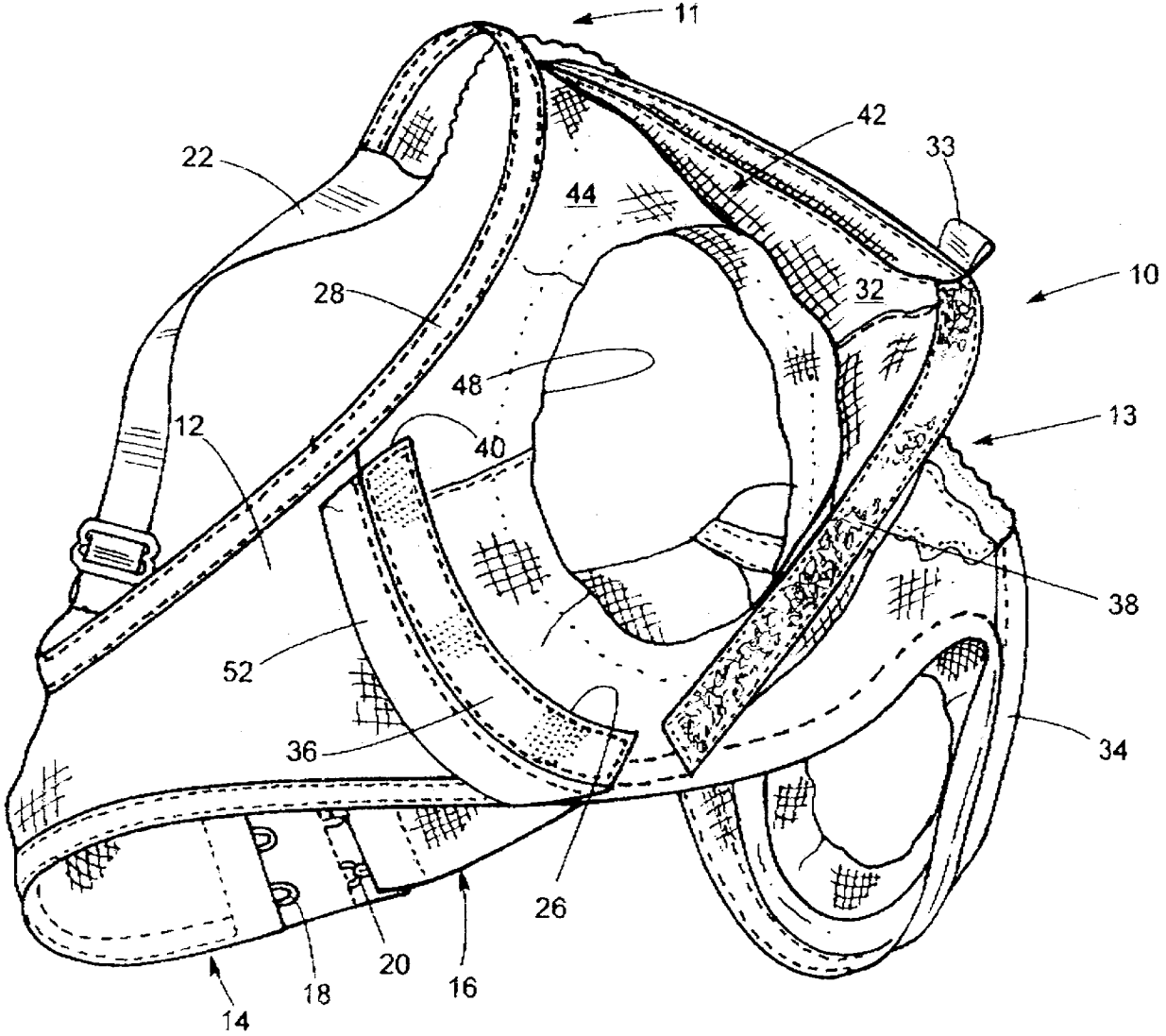
FIG. 2 is a perspective view of a portion of the nursing bra of FIG. 1 illustrating a portion of the exterior cup being pulled away by disconnection of the cup from a lateral side of the cup with opening movement of the cup being in a direction from the underarm area toward the center of the garment.

Referring now to the drawings and particularly to FIGS. 1 and 2, a nursing bra configured according to the invention is seen generally at 10. It is to be understood that the bra 10 could be a garment of other description as referred to hereinabove, such a garment typically including a bra function of varying degree or at least a garment having a portion of which covers the breast of a user and through which access is to be gained to permit the nursing function. A bra is shown as the nursing garment merely as a matter of convenience and for ease of illustration.

Prior nursing bras have cup elements normally covering the breast of a user and which are detachable in whole or in part from the bra at a top location such as is noted at 11 or at a center location such as is seen at 13 in the drawings. As indicated in the drawings, nursing bras and nursing garments typically provide bra cups or the like which either open downwardly from the top center of a bra cup or from the central portion of the bra. The present invention is based at least partially on the perceived fact that an infant nurses more naturally with its head in the crook of the arm of the mother. Given this teaching, a nursing bra is more effectively structured according to the present invention through initial detachment of a part of a bra cup on an outward lateral side of said cup so that the bra can be opened for nursing in a direction from the underarm area toward the center of the bra cup and toward the center of the bra itself.

The nursing bra 10 is seen to be formed of a foundation 12 which terminates on either side at locations behind the bra with bands 14 and 16 which can be at least partially elasticized as can be the foundation 12. The bands 14 and 16 are provided at free ends thereof with respective fastener elements 18 and 20 which fasten the free ends of the bands 14, 16 together in a conventional manner to maintain the bra 10 in place on a user. Shoulder straps 22 can also be employed in a conventional manner to hold the bra 10 in place on a user and to offer a desirable degree of support. A clasp 19 having a conventional C-shape can be employed to connect separable portions of each of the straps 22 in order to facilitate use of comfort-producing structural elements shown in FIGS. 4 through 7 as described hereinafter.

At locations in the front of the bra whereby portions of the foundation 12 typically surmount the respective breasts of a user, openings 24 and 26 are formed in the foundation 12, the respective breasts of a user extending through the openings 24, 26 at least partially. A strap-like portion 28 of the foundation 12 extends about upper peripheral portions of the opening 24, a strap-like portion 30 of the foundation 12 similarly extending about upper peripheral portions of the opening 26 on the other side of the bra 10.

The openings 24 and 26 are respectively closed as particularly seen in FIG. 1 by exterior bra cups 32 and 34, which cups have peripheral portions which are releasable from connection to the foundation 12 in order to gain access to a breast normally covered by one of the cups 32, 34 to permit the nursing function. Essentially the cups 32, 34 function in an identical manner and the following description will describe only the function of the cup 32 for convenience. As is seen in FIGS. 1 and 2, the cup 32 is provided along a portion of its periphery and on under surfaces thereof with one complementary portion of a hook and pile fastener such as Velcro, this fastening material being preferably formed as separate strips 36 and 38 which can be either the hook or loop material. As shown, the strip 38 takes the form of the hook element. The strip 36 of felt, pile or loop material is located about lower portions of the periphery of the opening 24, the strip 36 being positioned to engage the strip 38 on disposition of the cup 32 in a position closing the opening 24. It is to be understood that the respective strips 36, 38 can extend substantially about the lower periphery of the opening 24 and cup 32, thereby providing support to the breast of a user or could be configured to provide respective tab-like portions at mating loci only at a substantially outermost location such that the hook and loop fasteners will only hold the cup 32 at one location of the lateral side of the cup, the fastening elements then being manually disengaged at that one location in order to open the cup 32 in a direction from the underarm area of a user toward the center of the bra 10. On the other hand, the complementary hook and loop fastener structure could be provided about the entire periphery of the opening 24 of the cup 32 as a convenient expedient for attaching the cup 32 to the foundation 12. More typically, that portion of the periphery of the opening 24 between outer free end 40 of the strip 36 and the location whereby one of the straps 22 connect to the strap-like portion 28 of the bra 10 is open, that is, is free of connection between the foundation 12 and the cup 32, remaining peripheral portions between the strap 22 and the juncture of the two cups 32, 34 together being typically fastened permanently such as by sewing.

Figure 3:
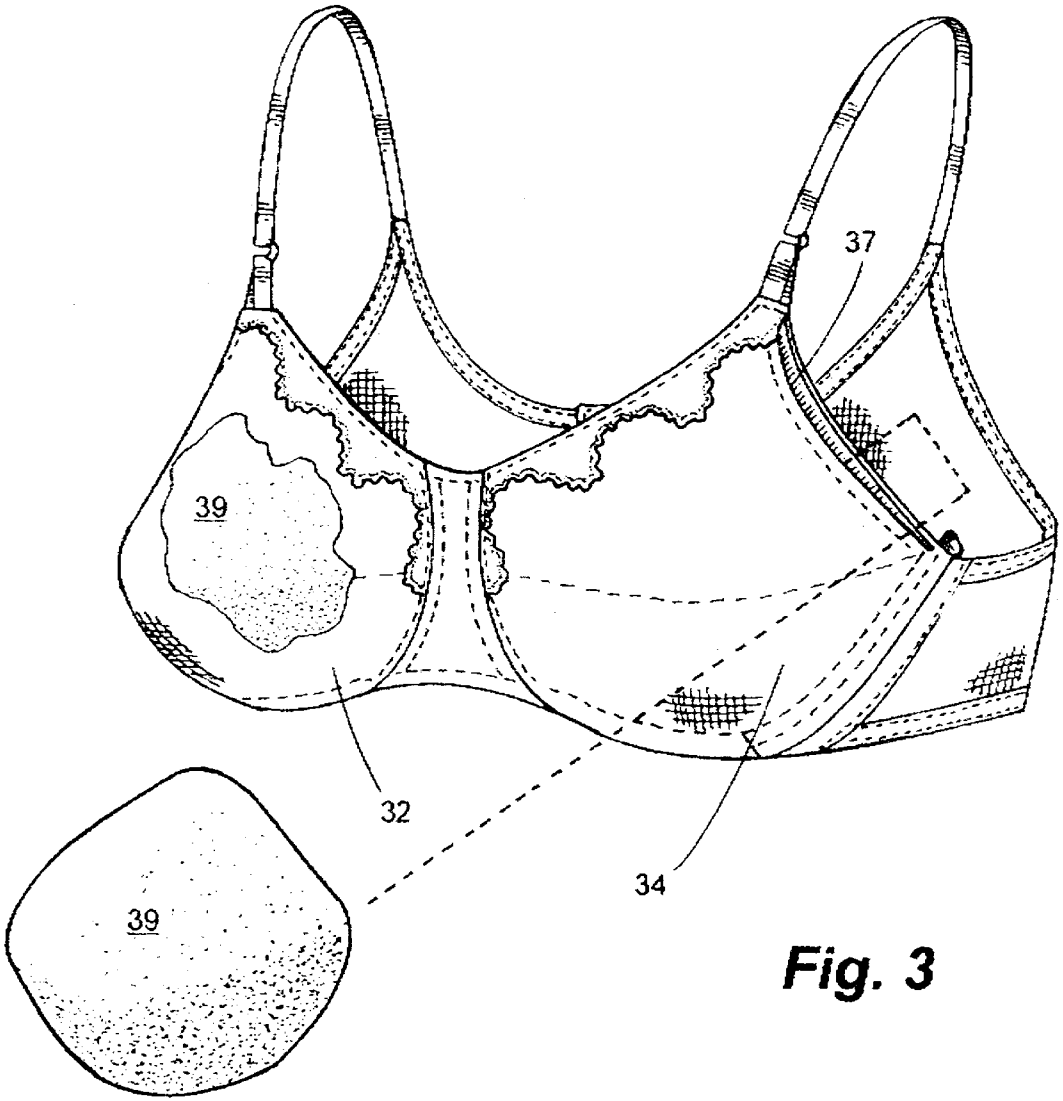
FIG. 3 is a perspective view illustrating the placement of a shaped pad into a pocket formed in a cup of a bra.
Figure 7:
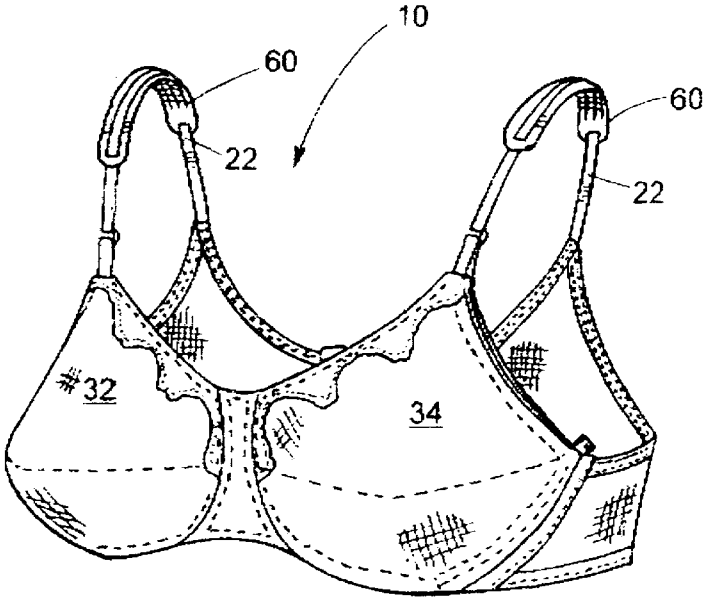
Figure 6:
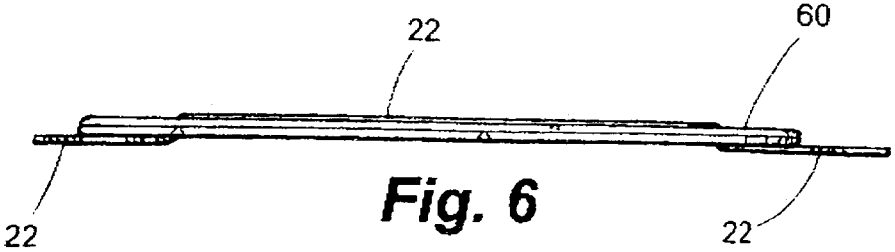
FIG. 6 is a side elevational view of the pad and strap arrangement of FIG. 4; and, FIG. 7 is a perspective view of the pad of FIG. 4 in place on each strap of a bra.
Figure 5:
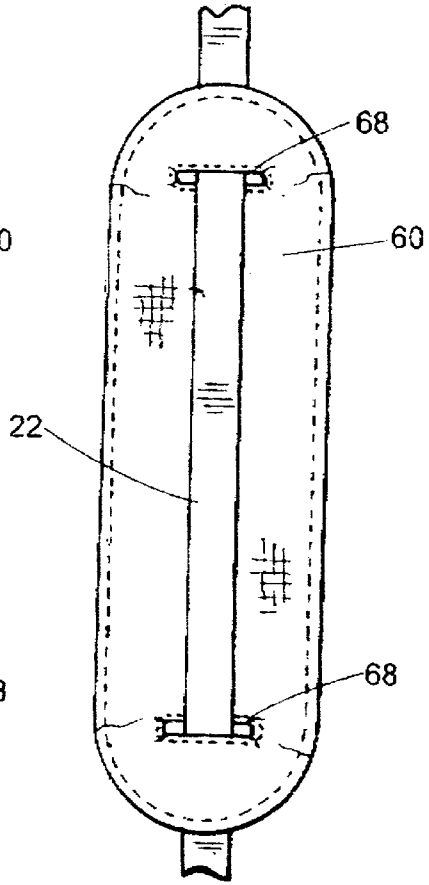
FIG. 5 is a plan view of the pad and strap arrangement of FIG. 4.
Figure 4:
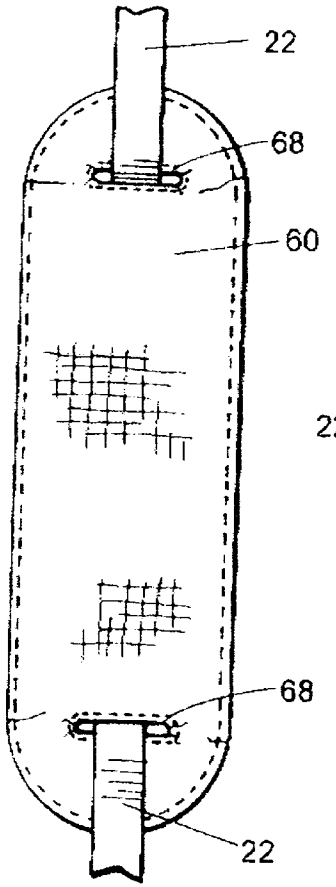
FIG. 4 is a view of the underside of a pad configured to slip onto a strap of a bra.

As an option, each of the cups 32, 34 can be formed of two layers of material to form a pouch 37 therebetween for insertion of a pad 39 thereinto as is best seen in FIG. 3. The pad 39 functions as an absorbing structure and provides additional comfort to the user.

Given the typical structure referred to above, the cup 32 can be grasped manually at a location immediately above the free end 40 of the strip 36 and pulled away in a direction from the underarm area toward the center of the bra 10 to provide any necessary degree of exposure of the breast of a user for permitting the nursing function. A tab 33 can be disposed at this location to permit grasping of the cup to facilitate displacement of the cup 32. It is to be understood that the permanent attachment such as at 42 of the cup 32 from upper to centered locations is not necessary to a practice of the invention nor is the disposition of the hook and loop fastening elements over lower and side portions of the opening 24/cup 32 necessary to provide the function of the invention as envisioned. Such fastening or differing amounts of the different kinds of fastening over major portions of the peripheries of the opening 24 and the cup 32 simply provides a bra 10 which is better capable of providing typical bra function. It is to be understood that stays, underwires, etc. can be provided at usual locations of the bra 10 in order to provide usual bra function although this structure is not shown in the drawings due to the conventional nature of such structure.

It should also be understood that fasteners other than the hook and loop fasteners shown can function in place of hook and loop fasteners. Snaps, buttons, hooks, etc., can be used to releasably join at least portions of the cups 32, 34 to the foundation 12.

Immediately inwardly of the openings 24, 26, interior cups 44, 46 are respectively located, outer peripheral portions of the cups 44, 46 being typically connected about the periphery of the respective openings 24, 26 such as by sewing, adhesion, etc. The interior cups 44, 46 are intended to provide a support function as well as a partial covering function when the exterior cups 32, 34 are pulled back to uncover the respective openings 24, 26. The interior cups 44, 46 are provided respectively with central apertures 48, 50 through which at least a portion of a user's breast can extend in order to permit the nursing function.

In order to prevent any portion of an infant's face from contacting the relatively rough strip 36 of complementary fastener material, strips 52, 54 are attached to outer surfaces of the foundation 12 about portions of the periphery of the openings 24, 26 in order to cover exposed portions of the strip 36 with a soft material which will be less abrasive to the skin of the infant.

A strip 66 of a soft, cloth-like material is seen to have spaced slots 68 formed centrally of the strip 66. The slots 68 allow receipt of one of the straps 22 therethrough so that the strip 66 can be positioned between the strap 22 and the shoulder of a user, the strip 66 being slidable along an upper portion of the strap 22 to a desired location when the upper portion of the strap 22 is slipped off of an upper portion of the clasp 19. The strips provide additional comfort to a user.

It is believed apparent from the foregoing that the invention can be configured in ways other than as explicitly shown without departing from the scope of the invention. In particular, fastening structures of convenient and conventional configuration can be employed as a replacement for some or all of the hook and loop fasteners, such fastening structures typically being buttons, zippers and the like. Accordingly, it is to be understood that the invention can be practiced other than as shown herein and that the scope of the invention is to be limited only by the recitation of the appended claims.

What is claimed is:

1. A method for improving access of a nursing infant cradled in the crook of an arm of a nursing mother with a breast of the nursing mother wearing a nursing bra having at least one opening formed therein through which said breast and a nursing portion thereof at least partially extends, the breast being covered when in a non-nursing mode by means of a bra cup mounted releasably over the opening, the method comprising the steps of:

detaching the bra cup from the bra at a location proximus to an underarm of the arm of the mother in which the infant is cradled; and, opening the bra cup to expose the opening and the nursing portion of the breast extending at least partially therethrough in a direction from the underarm toward front central portions of the bra to permit nursing of the nursing infant.

2. A nursing garment having a portion thereof which functions as a bra, the garment improving the nursing of an infant held in the crook of an arm of a nursing mother, the garment comprising:

a foundation having at least one opening formed therein which surmounts at least one breast of a user and is disposed on the side of the bra adjacent the arm holding the infant for nursing, the opening permitting access to the user's breast;

a bra cup only being disposed over the opening; the opening being inaccessible when the bra is disposed over the opening; and, fastening means for releasably joining a location of the foundation adjacent the opening and at a location proximus to an underarm of the arm of the mother in which the infant is held with a location of the bra cup surmounting the location of the foundation, the bra cup being detached from the foundation at the location of the foundation and pulled toward central portions of the bra to expose the opening, the opening being accessible on displacement of the bra cup from a position over the opening, the opening being unblocked by other structure, thereby to permit access for improvement of the nursing function.

3. The nursing garment of claim 2 and further comprising an interior cup disposed within the opening and having a central aperture formed therein.

4. The nursing garment of claim 2 wherein the fastening means comprise a complementary hook and loop fastener, a first strip of one cooperating portion of the fastener being connected to the foundation about at least a portion of the periphery of the opening and a second strip of a second cooperating portion of the fastener being connected to the underside of the bra cup, the strips being disposed at least at the respective locations of the foundation and of the bra cup to allow joining between the strips, thereby to releasably hold the bra cup to the foundation.

5. The nursing garment of claim 4 and further comprising means disposed adjacent the first strip of the fastener and being connected to the foundation for covering the first strip when the bra cup is detached from the foundation.

6. The nursing garment of claim 5 wherein the covering means comprise a strip of relatively soft fabric material.

7. The nursing garment of claim 4 wherein the strips extend over lower portions of the opening formed in the foundation and of the bra cup and terminate at lateral side locations of said foundation and said bra cup, said lateral side locations being proximus to the underarm of the nursing mother.

8. The nursing garment of claim 7 wherein at least certain other peripheral portions of the bra cup not fitted with the second fastener strip are permanently connected to certain portions of the foundation disposed about the periphery of the opening which is surmounted by the bra cup.

9. The nursing garment of claim 8 wherein said portions of the bra cup and foundation are sewn together.

10. The nursing garment of claim 8 wherein at least certain portions of the foundation about the periphery of the opening and at least portions of the periphery of the bra cup surmounting said portions of the foundation are not joined together.

11. The nursing garment of claim 10 wherein the portions of the foundation and of the bra cup which are not joined together are located substantially along top portions of the respective peripheries and extend from the point laterally of the bra cup at which the releasable fastener is located or terminates.

12. The nursing garment of claim 2 wherein the foundation is provided with two openings, one each surmounting each breast of a user and each opening having one bra cup releasably mounted to the foundation over one of the respective openings.

13. The nursing garment of claim 2 wherein each bra cup is formed with a pocket, the garment further comprising a pad receivable into the pocket.

14. The nursing garment of claim 2 and further comprising means disposable on the bra for preventing cutting of the portions of the bra into the skin of a user.

* * * * *